US006076666A

United States Patent [19]

Santa-Maria

[11] Patent Number: 6,076,666

[45] Date of Patent: Jun. 20, 2000

[54] GARMENT BAG

[76] Inventor: Toni M. Santa-Maria, 115 Rte. 32A, Saugerties, N.Y. 12477

[21] Appl. No.: 09/168,253

[22] Filed: Oct. 8, 1998

[51] Int. Cl.[7] ..... A45C 13/00; B65D 85/18

[52] U.S. Cl. ..... 206/287.1; 190/18 A; 190/109; 190/115; 206/290; 206/292

[58] Field of Search ..... 190/1, 115, 39, 190/107, 18 A, 109; 206/282, 286, 288, 289, 292, 287, 287.1, 290, 291; 383/22, 23

[56] References Cited

U.S. PATENT DOCUMENTS

| | | | |
|---|---|---|---|
| 2,175,387 | 10/1939 | Goding | 206/7 |
| 4,098,376 | 7/1978 | Pelavin . | |
| 4,342,389 | 8/1982 | Bethune et al. | 206/288 |
| 4,438,844 | 3/1984 | Kesselman et al. . | |
| 4,613,039 | 9/1986 | Shaw et al. . | |
| 4,662,513 | 5/1987 | King et al. . | |
| 4,736,854 | 4/1988 | King et al. . | |
| 4,753,342 | 6/1988 | Pulichino, Jr . | |
| 4,887,700 | 12/1989 | Rice . | |
| 4,898,274 | 2/1990 | Stout et al. . | |
| 4,901,897 | 2/1990 | Briggs et al. | 224/153 X |
| 4,905,826 | 3/1990 | Martin . | |
| 4,951,816 | 8/1990 | Smith . | |
| 5,060,795 | 10/1991 | Bomes et al. . | |
| 5,099,989 | 3/1992 | Goodin . | |
| 5,316,140 | 5/1994 | Purkiss . | |
| 5,320,220 | 6/1994 | Purkiss . | |
| 5,330,049 | 7/1994 | Bertelsen et al. . | |
| 5,400,900 | 3/1995 | Myers . | |
| 5,413,198 | 5/1995 | Ferris . | |
| 5,425,449 | 6/1995 | Boorady . | |
| 5,469,967 | 11/1995 | Boorady . | |
| 5,505,297 | 4/1996 | Myers . | |
| 5,628,397 | 5/1997 | Ham | 206/287.1 |

*Primary Examiner*—Allan N. Shoap
*Assistant Examiner*—Reoll A. Brown

[57] ABSTRACT

A garment bag that folds into a suitcase with hanger retainers at each end and with a front and a back with the two halves of the front opposing one another when folded into a suitcase and with each half being rotatable 180 degrees so that the two halves of the back oppose one another permitting clothes on both hanger retainers to hand down and be readily selected from the garment bag when the garment bag is hung from both ends with both front halves exposed.

8 Claims, 3 Drawing Sheets

GARMENT BAG

BACKGROUND OF THE INVENTION

1. Field of the Invention

The present invention relates to luggage and in particular to a garment bag with two halves that fold together.

2. Prior Art and Objects

Garments bag have been well known and garment bags with varying styles and features exist. Garment bags generally involve an elongated generally rectangular bag having two halves which fold together to form a suitcase. Garment bags are particularly used for longer clothes such as long dresses and suits. Traditionally, such clothing is hung at one end of the garment bag. As the garment bag is folded, so do the clothes therein fold. It is usual for the garment bag to be folded so that the two front halves of the garment bag oppose one another to form a suitcase.

Various means are used to hold the two halves together so that the two halves are not being pulled apart when being carried. A handle is usually at the middle of the back to hold the garment bag with both ends directed downward.

The difficulty with such garment bags, as many travelers have experienced, is that many garments have enlarged tops which may be caused by shoulder pads or short tops with long dresses or pants, so that only a few garments can be hung on the one hanger retainer in the garment bag. However, despite the lack of space to hang clothes, a major portion of the opposite halve of the garment bag from the hanger retainer remains unused. People do use this section of the bag for small items which are not placed on a hanger. Thus, the unused space at the end of the garment bag, remote from the hanger retainer, is not fully utilized for its best purpose since small items can readily be placed in a standard suitcase. By utilizing the space in the garment bag for such smaller items rather than the long clothes, results, in all likelihood, in another garment bag being required. Therefore, the need for a garment bag and, in particular, a garment bag to carry long clothing such as suits and long dresses and coats remains a priority.

Frequently travellers, who intend to stay only a short time in a temporary residence, hang up the bag, usually in a closet, leaving their clothes in it. However, the small items must be removed since, with the bag open, the small items will be difficult to locate and most likely will fall out of the garment bag.

To overcome this situation, in accordance with this invention, a hanger retainer is located at both ends of the garment bag. The garment bag has two halves with a flexible midsection between them so that the two halves can each be folded around 180 degrees from the closed position with the front halves opposing one another to a totally opposite position in which the halves of the back oppose one another. Hooks are provided outside the garment bag at both ends of the garment bag permitting both ends to be hung from a suitable horizontal bar as should be found in a closet. With the garment bag hung from both ends with the back opposing itself, the midsection is open which permits the clothing on each hanger retainer to hang down and be readily available for removal. The use of only flaps on each half of the front of the bag assists in the ease of removal of clothing from both halves of the garment bag when so hung from both ends.

In order to obtain this result, a garment bag is provided which permits clothing to be hung at both ends of the garment bag permitting the garment bag to carry an increased number of long garments, such as suits and dresses, and also make such garments more accessible from the garment bag without unpacking.

Accordingly, it is an object of the present invention to provide a garment bag that has increased capacity without enlarging the size of the bag.

It is another object of the invention to provide a garment bag that permits clothes to be hung at both ends.

It is another object of the invention to provide a garment bag that can be hung up when opened in a closet with the clothes available from both ends of the garment bag without having to remove the clothing from the garment bag and hang it individually in a closet.

It is another object of the invention to provide the garment bag which is secure when closed and does not open when being handled during travel.

It is another object of the present invention to provide a garment bag that is both durable and economical.

Other objects and advantages of the present invention will become apparent to those of ordinary skilled in the art the description thereof proceeds.

SUMMARY OF THE INVENTION

In accordance with the present invention a garment bag is provided which has some of the basic features of garment bags currently used namely a garment bag that folds together with the two ends generally aligned with one another to form a suitcase. The garment bag, however, in accordance with this invention provides a hanger retainer at both ends of the garment bag permitting garments to be hung at both ends so that the space at both ends of the garment bag can be utilized efficiently for holding long garments, such as suits and long dresses, which are the garments for which garment bags are intended.

Consistent with known garment bags, the bag includes a back fully enclosed by a back panel. The garment bag has two sides enclosed by side panels and the garment bag has two ends enclosed by end panels. The garment bag is formed so as to be folded with two end sections and a mid-section. The mid-section provides the point where the garment bag is folded in both directions. The back panel within each end section is substantially the same size and configuration and the back panel of both end sections is located on opposite sides of the back panel within the mid-section of the garment bag. The back panel, which generally has a rectangular configuration, but with rounded corners, has an edge all the way around it and both end panels and the side panels are securely mounted to that edge at substantially right angles to the edge. The side panels of the garment bag are longer than the end panels. The side panels also have edges, namely a back edge and a front edge which are generally parallel to one another. The side panels are split at the midsection from the front edge to the rear edge and further provide a flexible section about the split. At the mid-section of the garment bag, the back panel is flexible to permit the 360 degrees of rotation of the garment bag from the fully closed position with the front within the two end sections being opposed or facing one another to the back panel in each end section being opposed to one another thereby permitting the garments to hang down from both hanger retainers.

The front of the garment bag, which is opposite from and generally parallel with the back, is not enclosed but rather has just flaps, which may be secured to one another when used to close the front of the garment bag. The flaps are mounted to rotate on the front edges of the side panels of each end section. The flaps are used to hold the clothes in place when the bag is being folded. A retaining means is preferably used to secure the flaps together.

Rotatable hooks are located at both ends of the garment bag on the outside for hanging both ends of the garment bag on the bar of a closet with the back panels of each end section facing one another. When this occurs, the clothes which are hung at opposite ends of the garment bag, drop down and hang within the garment bag for ready removal through the front of both end sections of the garment bag.

Preferably a zipper extends around from back panel to back panel along the split in the side panels and along the front edge of the side panels and the front edge of the end panels to secure the bag together when folded closed with the front panel opposing or facing itself.

At the mid-section, on the outside surface of back panel, a handle is located generally mid-way between the two side panels and also preferably a shoulder strap is also located generally symmetrically on the back panel at the mid-section for carrying the bag with the two ends of the bag extending downward when the garment bag is being carried.

Optionally, corner pockets may be provided in each of the four corners of the garment bag for placing small items such as shoes and undergarments and having them accessible but securely retained when the garment bag is hung open.

Similarly, pouches may be provided on each end section of the back panel to permit storage of small items and accessibility to these items when the garment bag is either fully closed or fully open.

A retractable handle and wheels, which are known, may also be used on one of the two end sections of the garment bag so that the garment bag, when closed can be wheeled and not have to be carried.

BRIEF DESCRIPTION OF THE DRAWINGS

The object and the advantages of the invention will become apparent from the following detailed description of the preferred embodiment thereof in connection with the accompanying drawings in which like numerals designate like elements and in which.

DETAILED DESCRIPTION OF THE PREFERRED EMBODIMENT

Figure 1:
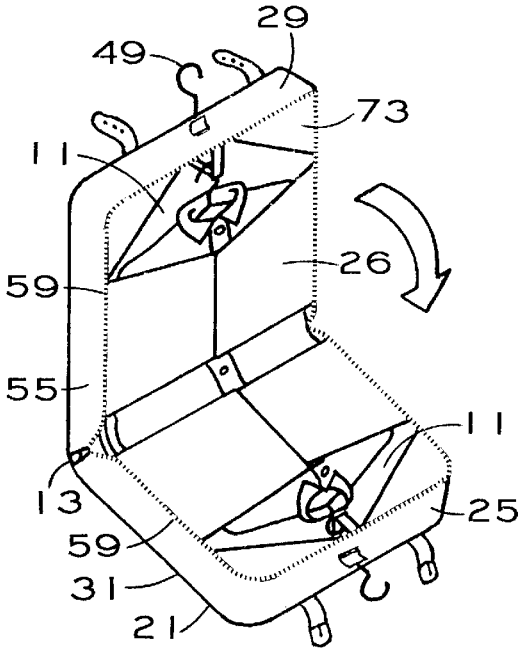
FIG. 1 is a pictorial view of the garment bag showing the garment bag approximately partially open between the fully closed position and the single plane position with an arrow indicating the movement of the bag to the fully-closed position.
Figure 2:
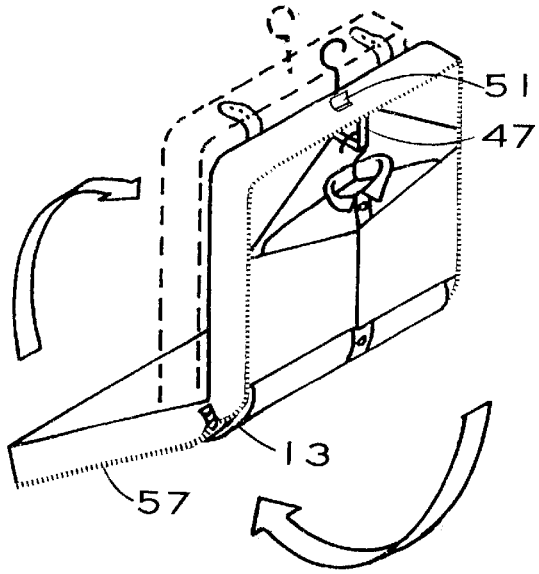
FIG. 2 is a pictorial view of the garment bag opened beyond the single plane position toward the fully open position with an arrow showing the direction to rotate the garment bag to the fully open position with the one end section of the garment bag also shown in italics to show the location of that end section when the garment bag is fully open.
Figure 3:
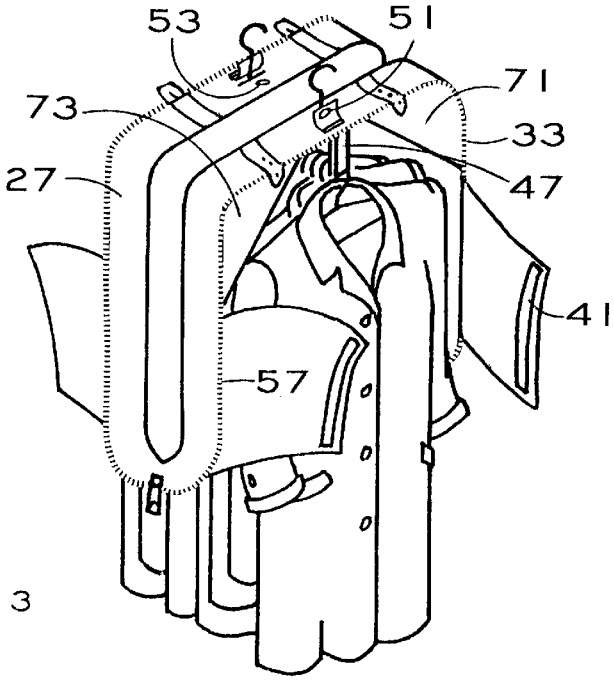
FIG. 3 is a pictorial view of the bag in its fully-open position with each of the two end sections of the back panel opposing one another and with the hooks for placement on a suitable bar for hanging the garment bag with clothes in the garment bag hanging down from each hanger retainer at the two ends of the garment bag and with the flaps on the front of the garment bag thereon open to permit access to the clothing in the garment bag.

Referring now to FIGS. 1 through 3, the garment bag is shown as having two end sections 11 and a mid-section 13. It is at the mid-section 13 that the garment bag folds to be either fully closed or fully open as will be explained hereinafter. The garment bag has a back 15 which is fully enclosed by a back panel 17. The back panel 17, which has a generally rectangular shape with rounded corners 19, has an edge 21 around it. The garment bag also has two sides 23 and two ends 25. The two sides 23 are longer than the two ends 25. The two ends 25 form the top of the garment bag when the garment bag is fully open and the bottom of the garment bag when the garment bag is fully closed and ready for travel. The garment bag also has a front 26 generally parallel to and in a spaced relationship to the back 15.

The two sides 23 and the two ends 25 of the garment bag are closed by side panels 27 and end panels 29. The side panels 27 and end panels 29 each have back edges 31 and front edges 33. The side panels 27 and the end panels 29 are preferably formed in one piece, but, in any event, are secured together except for a slot in each side panel 27 midway between the end panels 29. The back edge 31 of the side panels 27 and end panels 29 is secured to the back panel 17 along the edge 21 of the back panel 17 generally at right angles to the back panel 17.

A slot 35, which is located substantially midway between the two end panels 29 in the midsection 13 of the side panels 27 extends generally at right angles to the back panel 17 from the front edge 33 to the back edge 31. The slot 35 permits the garment bag to be rotated to its fully open position. As a result, half of one side panel 27 extends into one end panel 29 which extends into half of another side panel 27 on the opposite side of the back panel 17.

The side panels 27, the end panels 29 and the back panels 17 form an enclosure 37 into which garments and other items are placed for travel purposes.

The front 26 of the garment bag has no panel to enclose it. Instead, the front 26 of the garment bag has, within each of the two end sections 11, a pair of flaps 39 which are mounted on the front edge 33 of the two side panels 27. The flaps 39, when closed, leave the front 26 of the garment bag partially open and are intended only to hold clothing in place while the garment bag is being closed. As seen in FIG. 3, a retainer 41, such as hook and loop material, is used to hold the two flaps 39 of each pair of flaps 39 together Other forms of a retainer 41 may be used, such as snaps or buttons, but hook and loop material forms a retainer 41 that is secure and yet can be easily opened and closed.

The garment bag has an outside surface 43 and an inside surface The inside surface 45 forms the interior of the garment bag which is the enclosure 37.

On the inside surface 45, at the center of each end panel 29, there is secured a hanger retainer 47. At the center of each end panel 29, on the outside surface 43, opposite from the hanger retainer 47, there is a hook 49. The hook 49 is preferably rotatable so that it can be turned to permit easy placement on a bar or rod. Each hook 49 is preferably also capable of being folded down and held in place by a cover 51 having a snap 53 to hold the cover 51 down over its respective hook 49 so that the hooks 49 do not rattle and catch on objects when the garment bag is being carried.

Figure 4:
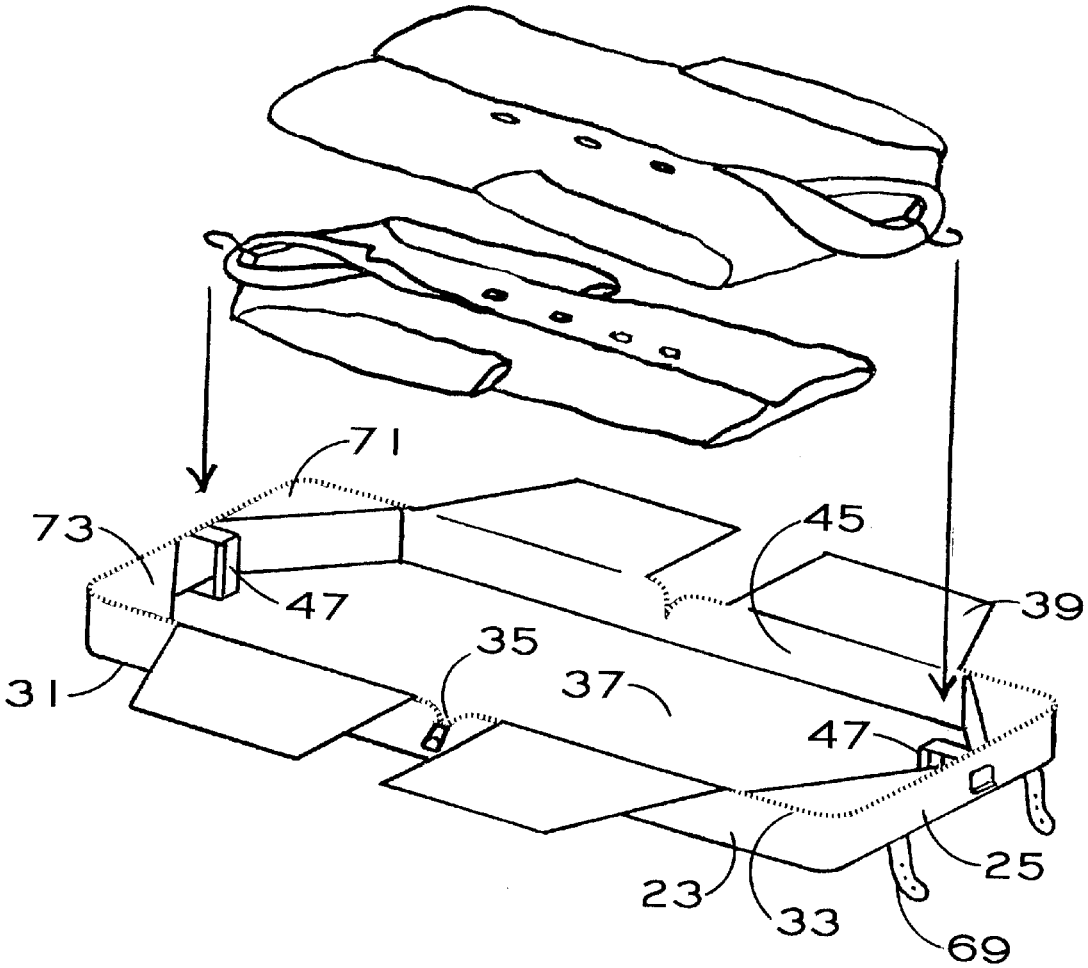
FIG. 4 is an exploded pictorial view showing the garment bag in the single plane position with two individual pieces of clothing each being placed on a hanger retainer at opposite ends of the garment bag and with the flaps on the front of the garment bag open.

When the garment bag is placed in a single plane position or as otherwise might be stated, is laid flat, as shown in FIG. 4, the slot 35 in the side panels 27 between the two end sections 11 of the garment bag should be generally equally spaced along the length of each slot 35. About each slot 35 there is a flexible and expandable section 55 which folds over itself when the garment bag is folded closed. When the garment bag is rotated to its fully open position, the back panel 17 which is flexible at the mid-section 13 of the garment bag, bends and the slot 35 opens wider and wider to accommodate the bending of the back panel 17. As the garment bag is returned to a single plane position, as shown in FIG. 4, the slot 35 once again becomes substantially even along its length. Then, as the garment bag is rotated to its fully closed position, as shown in FIG. 5 and FIG. 6, the flexible and expandable section 55 folds together leaving the slot 35 generally equally spaced.

A zipper 57, which preferable is two zippers which meet one another, starts adjacent the back panel 17 thus first closing the slot 35 and then the front edge 33 of the two side panels 27 and the two end panels 29 together. The zipper 57, as is well known with zippers, is formed from two interlocking parts 59. Each interlocking part 59 extends about the front edge 33 of the side panels 27 and end panel 29 within one of the two end sections 11. The other interlocking part 59 extends about the front edge 33 of the side panels 27 and end panel 29 within the other end section 11. Otherwise stated, one interlocking part 59 of the zipper 57 extends about the front edge 33 from slot 35 to slot 35 in one of the two end sections 11 and the other interlocking part 59 of the zipper 57 extends about the front edge 33 from slot 35 to slot 35 of the other of the two end sections 11.

Figure 5:
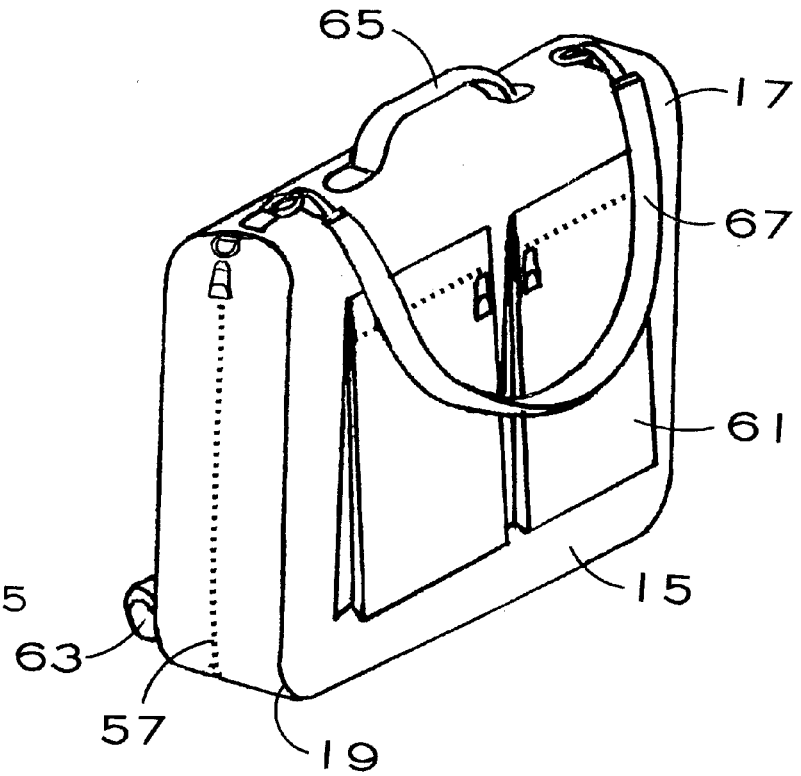
FIG. 5 is a pictorial view of the bag in its fully-closed position retained by a zipper and also showing optional outside pockets or pouches and the handle and shoulder strap for carrying the bag as well as optional wheels for rolling the garment bag.
Figure 6:
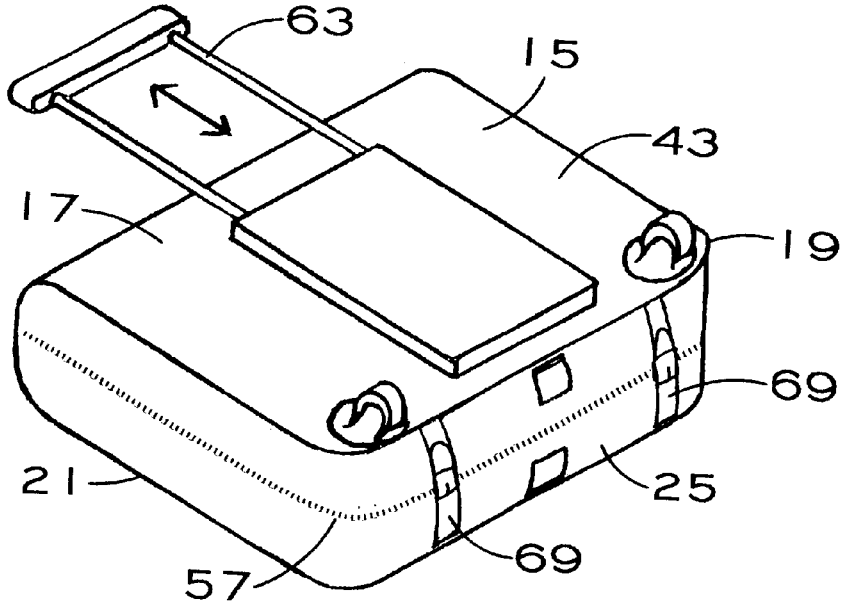
FIG. 6 is a pictorial view showing the bag in its fully closed position retained by a zipper and showing a security latch across both ends of the garment bag and further showing a standard retractable handle and wheels for wheeling the bag.

As seen in FIG. 5, side pockets or pouches 17 of various forms may be placed on the outside surface 45 of the back panel 17 to provide additional carrying space. As another option, a retractable handle and wheels 63, as shown in FIG. 6, can be added to the garment bag to provide the convenience of being able to roll the garment bag and not have to carry it.

The side pockets 61 are particularly convenient when the garment bag is fully closed as items needed during a trip can be conveniently reached without opening the garment bag. When the garment bag is fully opened, as shown in FIG. 3, there is still adequate space between the two end sections 11 to reach items in the side pockets 61.

As seen in FIG. 5, when the garment bag is fully closed and ready for travel, the outside surface 43 of the midsection 13 is the top of the resulting luggage. Thus, generally centrally at the mid-section 13 on the outside surface 43, a handle 65 is located on the garment bag. For ease in carrying, a shoulder strap 67 is also generally symmetrically located about the handle 65 on the outside surface 43 of the mid-section 13 of the garment bag.

As seen in FIG. 6, a pair of safety straps 69 can be located across the zipper 57 on the two end panels 29 to secure the two end sections 11 of the garment bag together without placing stress on the zipper 57. Since the hooks 49 are located generally centrally on the end panels 29, the safety straps 69, are generally symmetrically located on opposite sides of the hooks 49.

As seen in FIG. 1 and FIG. 2, corner enclosures 71 may be added to the enclosure 37 of the garment bag. Such corner enclosures 71 provide space for items such as shoes that are readily accessible when the garment bag is in the fully open position shown in FIG. 3. Covers 73 which are secured to the corner enclosures 71 by any suitable means, such as hook and loop material, assure the retention of small items that are placed in the corner enclosures 71.

In use, as best seen in FIG. 4, clothes are placed on the hanger retainers 41 at each end of the enclosure 37 thus allowing for more garments to be placed in the garment bag which garments are normally are most bulky at the top. The preferred way to pack the garment bag is to place garments into the enclosure 37 by alternating between the two hanger retainers 41. As best seen in FIG. 3 there is provided easy access to the clothes on both hanger retainers 41 without removal from the garment bag. Thus greater capacity and more ease of use is provided.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

What is claimed is:

1. A garment bag for carrying long garments hung within the garment bag from both ends of the garment bag and which garment bag can be folded together in one direction to carry the garment bag and which can be folded in the opposite direction to hang the garment bag permitting the clothing hung at both ends of the garment bag to hang down, said garment bag comprising:

a compartment having an inside and an outside with a back and two sides and two ends and a front, the back and front being generally rectangular, the sides being longer than the ends, the back, sides and ends being closed, the compartment having two end sections and a mid section between the two end sections, the mid section being flexible;

a pair of hanger retainers, one located on each of the ends on the inside of the compartment;

closing means for securing together the end sections with the two front sections adjacent each other, the back being folded at the midsection;

means outside the compartment secured to the ends for hanging the compartment; and handle means affixed to the outside of the compartment at the midsection.

2. A garment bag according to claim 1 wherein the back of the compartment has a rectangular shape with rounded corners.

3. A garment bag according to claim 1 wherein the sides of the compartment are longer than the ends.

4. A garment bag according to claim 1 wherein the closing means is a zipper.

5. A garment bag for carrying long garments hung within the garment bag from both ends of the garment bag and which garment bag can be folded together in one direction to carry the garment bag and which can be folded in the opposite direction to hang the garment bag permitting the clothing hung at both ends of the garment bag to hang down, said garment bag comprising:

a back panel having a generally rectangular shape with rounded corners and having an edge extending about it, the back panel having two end sections and a midsection located between the two end sections, each of the two end sections having substantially the same size and shape and the midsection being flexible;

a pair of side panels, each side panel having a back edge and a front edge, the back edge being secured to the edge of the back panel;

a pair of end panels, the side panels being longer than the end panels, each side panel having a slot extending through it from the front edge to the rear edge substantially midway between the two end panels, the side panels being flexible about the slot, the back panel, end panels and side panels forming an enclosure, the end panels being connected to the side panels;

a pair of hanger retainers, one located generally centrally on each of the end panels within the enclosure;

means for closing the enclosure mounted on the front edges of the side panels;

closing means for securing together the two end panels with the back panel folded at the midsection and with each of the two side panels folded together about the slot;

hook means located on each end section opposite from the hanger retainers for hanging on a bar when the end sections are folded about the midsection of the back section with the two end sections of the back panel adjacent one another; and handle means secured to the midsection.

6. A garment bag according to claim 5 wherein the means for closing the enclosure includes overlapping flaps.

7. A garment bag according to claim 5 wherein the closing means is a zipper.

8. A garment bag for carrying long garments hung within the garment bag from both ends of the garment bag and which garment bag can be folded together in one direction to carry the garment bag and which can be folded in the opposite direction to hang the garment bag permitting the clothing hung at both ends of the garment bag to hang down, said garment bag comprising:

a back panel having a generally rectangular shape with rounded corners and having an edge extending about it, the back panel having two end sections and a midsection located between the end sections, each end section having substantially the same size and shape and the midsection being flexible;

a pair of side panels, each side panel having a back edge and a front edge, the back edge being secured to the edge of the back panel;

a pair of end panels, the side panels being longer than the end panels, each side panel having a slot extending through it from the front edge to the rear edge substantially midway between the two end panels, the side panels being flexible about the slot, the back panel, end panels and side panels forming a compartment, the end panels being connected to the side panels;

a pair of hanger retainers, one located generally centrally on each of the end panels within the compartment;

one pair of flaps mounted on the front edge of both side edges over one end section and another pair of flaps mounted on the front edge of both side edges over the other end section to close partially the compartment;

means for securing each pair of flaps together;

a zipper means having two interlocking half sections, one interlocking half section extending along one slot about the front edge of the side panel and end panel and about the front edge of the other side panel and along one slot within one end section and the other interlocking half section extending along one slot about the front edge of one side panel and end panel and about the front edge of the other side panel and along the slot within the other end section, the two interlocking half sections of the zipper means being adjacent one another with the back panel folded at the midsection and with the front edges of the side panels and end panel adjacent front edges of the side panels and end panel of the other end section;

hook means located on each end section opposite from the hanger retainers for hanging on a bar when the end sections are folded about the midsection of the back section with the two end sections of the back panel adjacent one another; and handle means secured to the midsection.

* * * * *